US007331876B2

(12) United States Patent
Klein

(10) Patent No.: US 7,331,876 B2
(45) Date of Patent: Feb. 19, 2008

(54) INTEGRATED PUTTER SYSTEM

(76) Inventor: Lon Klein, 111-09 76th Rd., Apt. C-5, 3rd Floor, Forest Hills, Queens, NY (US) 11375

( * ) Notice: Subject to any disclaimer, the term of this patent is extended or adjusted under 35 U.S.C. 154(b) by 34 days.

(21) Appl. No.: 10/090,133

(22) Filed: Feb. 28, 2002

(65) Prior Publication Data

US 2003/0162599 A1 Aug. 28, 2003

(51) Int. Cl.
*A63B 53/06* (2006.01)
*A63B 53/14* (2006.01)

(52) U.S. Cl. ..... 473/251; 473/201; 473/300; 473/316; 473/305; 473/312

(58) Field of Classification Search ..... 473/251, 473/201, 300, 316, 305, 312, 318, 340, 341
See application file for complete search history.

(56) References Cited

U.S. PATENT DOCUMENTS 1,677,099 A 7/1928 Harness
2,784,969 A * 3/1957 Brandon ..... 473/290
2,926,913 A * 3/1960 Stecher ..... 473/314
3,075,768 A * 1/1963 Karns ..... 473/297
3,679,207 A * 7/1972 Florian ..... 473/292
5,133,555 A 7/1992 Bailey
5,165,688 A * 11/1992 Schmidt et al. ..... 473/315
5,489,097 A 2/1996 Simmons
5,511,790 A * 4/1996 Duran ..... 473/201
5,624,329 A * 4/1997 Schneebeli ..... 473/287
5,643,102 A * 7/1997 Hsien ..... 473/290
5,772,525 A * 6/1998 Klein ..... 473/300

* cited by examiner

*Primary Examiner*—Glenn Caldarola
*Assistant Examiner*—Tom Duong
(74) *Attorney, Agent, or Firm*—Fay Kaplun & Marcin, LLP

(57) ABSTRACT

A putter comprising a grip having an anatomically correct shape to promote proper grasping of the putter, a shaft having a first end and a second end, wherein the grip is attached to the first end of the shaft, a hosel attached to the second end of the shaft, a head attached to the hosel, the head having a striking face, and an alignment feature of the putter adapted to ensure correct assembly of the head onto the shaft.

12 Claims, 7 Drawing Sheets

INTEGRATED PUTTER SYSTEM

BACKGROUND INFORMATION

Since its beginnings, golf has been a favorite sport for members of the elite classes around the world. Since the Arnold Palmer era of the late 1950's, however, the popularity of the sport has increased exponentially as more golf courses have been built to accommodate the increased demand by the proletariat, and the perception that golf is a pastime only for the aristocrats has disappeared. Today, golf is played by people from every strata of society, on golf courses around the world. The public's general interest in golf is apparent by the amount of media coverage given to golf tournaments, and by the prominent status given to professional golfers.

Clubs, or "sticks" as they are affectionately called, are on the essential list of equipment necessary to the enjoyment of the game. Clubs are available in a wide variety of configurations, ideally suited for various terrains, types of shots at varying distances, and individual styles and preferences for a particular shot. The clubs may be generally classified in three broad categories: woods (or metals), irons and putters. Metals are normally used for long shots, and are capable of propelling the ball 300 yards or more in the hands of a skilled golfer. Irons are generally used for long, medium and short range shots where accuracy is most important, and may have a larger face angle to elevate the ball off the ground—for example, when the shot is made from a bunker or grassy knoll. Metals and irons are classified numerically according to the face angle of their striking surface, and their shaft length. The putter is used for a variety of short shots on, or close to, the greens surface. Ideally, a ball hit with a putter will skid, then roll on the ground, and will not become airborne for any appreciable distance.

Although putters are used for short range shots, they are designed to provide the greatest accuracy and feel of any club, since the object of putting is to roll the ball into the hole in the fewest strokes possible. To achieve this, the golfer has to estimate the force and direction to be imparted to the ball by the putter so that the ball will travel with the desired speed and direction, notwithstanding the effect of surface irregularities on the ball's path. This is a complicated and difficult task to perform with regularity, and the likelihood of success of any putt can be increased if the golfer maintains the proper grip, stance and body orientation when rolling the ball and swinging the putter along the proper path.

Traditional putters reflect design philosophies that are often 30 to 70 years old, and typically incorporate few features that assist the golfer in making a repeatable stroke. Often a putter design impedes correct application of the club itself to the task at hand. In some cases putters use sight lines or groove markings to help the golfer aim more accurately, but these devices often are confusing, distracting and ill-conceived. In addition, conventional putters are formed from many separate components that can be easily assembled inaccurately, leading to an inevitable misalignment error when striking the ball with the putter.

SUMMARY OF THE INVENTION

A putter comprising a grip having an anatomically correct shape to promote proper grasping of the putter, a shaft having a first end and a second end, wherein the grip is attached to the first end of the shaft. A hosel attached to the second end of the shaft, a head attached to the hosel, the head having a striking face and an alignment feature of the putter adapted to ensure correct assembly of the head onto the shaft.

Furthermore, a putter system for assisting a golfer in completing a putt, the system comprising a grip for anatomically matching the golfer's hands, the grip preferentially orienting in a selected direction when grasped, a shaft extending from the grip, the shaft providing visual indication of a preferred orientation of the shaft to the golfer, a head integrated with the shaft, the head providing visual indication to the golfer of a preferred orientation of the head and an alignment feature adapted to precisely align the head with the shaft.

In addition, a grip for a golf club comprising a monolithic piece having an end for attaching the grip to a shaft of the golf club, wherein the monolithic piece is an anatomically correct shape to promote proper grasping of the grip along a length of the monolithic piece. A shaft for a golf club, comprising a monolithic piece formed of one of a polymer and composite material, having a shaft portion for attaching to a grip of the golf club and a hosel portion for attaching to a head of the golf club, wherein the shaft portion includes a head orientation feature adapted to emphasize an orientation of the head. A head for a putter, comprising a body piece formed of one of a polymer and composite material having a striking face and a ball aiming feature adapted to facilitate obtaining a proper relationship between the head and a ball.

A method of manufacturing a putter comprising the steps of molding a grip of the putter, molding a shaft of the putter, the shaft having a shaft portion and a hosel portion, molding a head of the putter, said head having a striking surface, forming an alignment feature of the putter, and attaching the head to the hosel portion of the shaft, using the alignment feature to ensure correct alignment of the head with the shaft.

DETAILED DESCRIPTION

Figure 1:
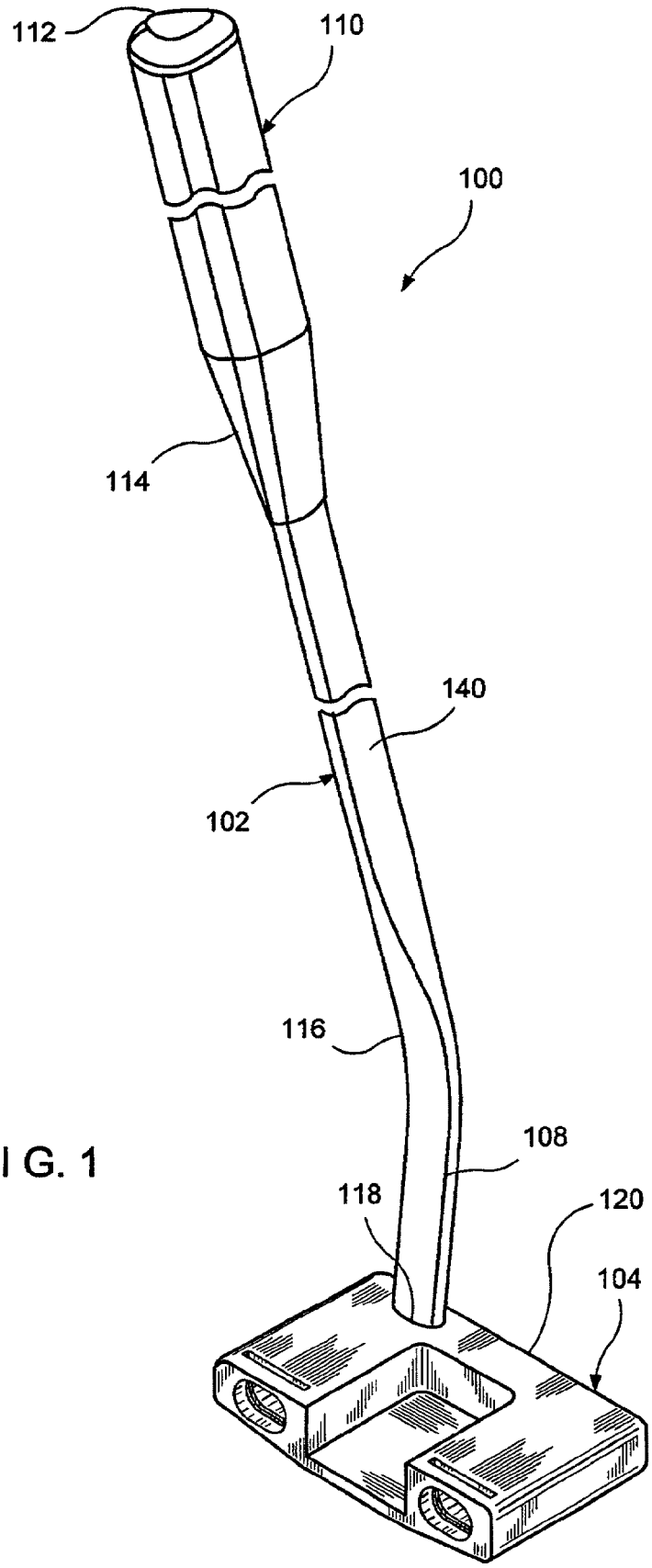
FIG. 1 is a perspective view showing an embodiment of the integrated putter according to the present invention.

The present invention may be further understood with reference to the following description and the appended drawings, wherein like elements are referred to with the same reference numerals.

Embodiments of the present invention include a putter that incorporates from its conception elements to facilitate its assembly and its correct use. Some of these elements, for example, include features that assist the golfer in properly grasping the putter, elements that promote proper stance and body alignment during the swing, and elements that facilitate alignment of the putter's face and head with the ball. Other design features of the present invention facilitate assembly of the putter, and customization of the putter for individual player preferences and under varying playing conditions.

The overall putter is described with reference to FIGS. 1 through 4. According to an exemplary embodiment of the invention, putter 100 includes a grip 110, a shaft 102, a hosel 108 and a head 104 that are designed to be integrated into a putting system, so that each of these components work together to provide the desired benefits to the user. Although these components may be made separately and joined in the assembly process, as will be fully explained below, their features work in conjunction.

In the exemplary embodiment shown in the drawings, shaft 102 and hosel 108 may be formed from a polymer as a single, monolithic part. For example, the polymer may be a thermal plastic material or any of the known polymer or polymer/composite materials. The process to form the shaft 102 and hosel 108 may be, for example, injection molding, compression molding, other molding processes, extrusion, filament winding, sheet wrapping, etc. The hosel 108 is shaped to connect the shaft 102 with the head 104 which, as described below, assures the proper orientation and alignment between the shaft 102 and head 104. The grip 110 may also be formed from a polymer using the same manufacturing methods as for the shaft 102 and hosel 108. The grip 110 may then be secured to the shaft, for example, by molding the grip 110 over the shaft 102. Thus, the grip 110 and hosel 108 are at opposing ends of the shaft section which may be of varying length.

Figure 9:
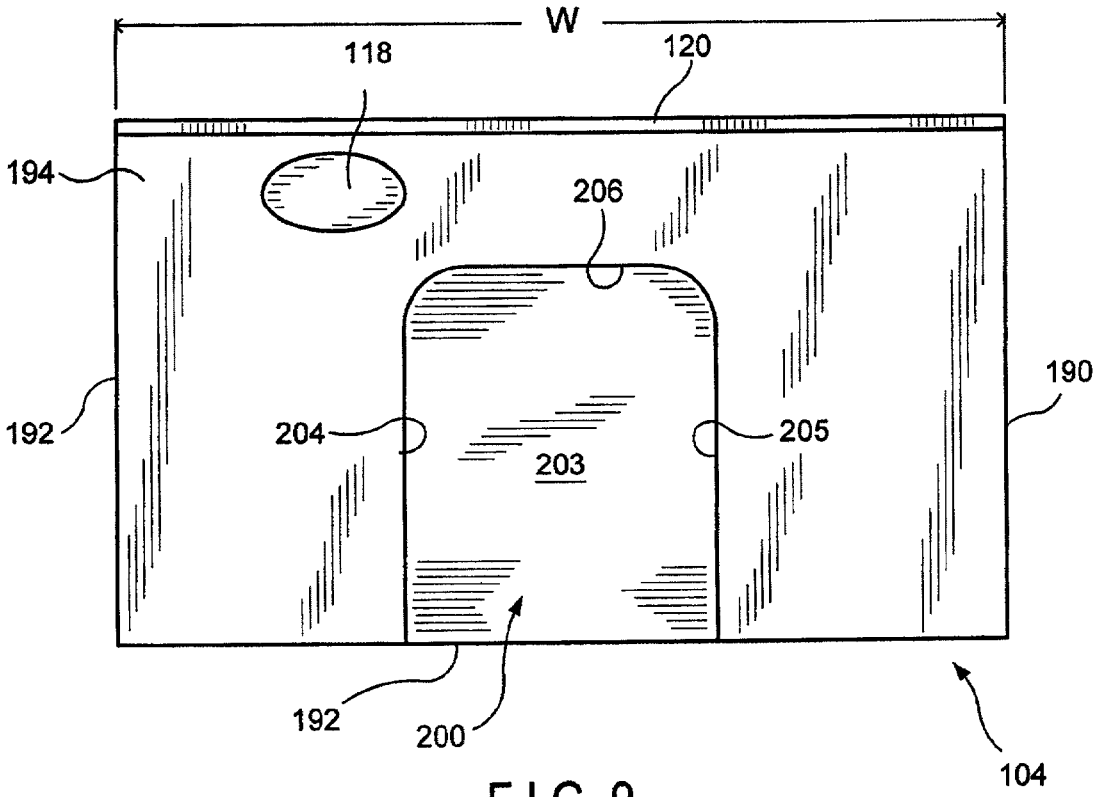
FIG. 9 is a top view showing the head portion of FIG. 7.

The hosel 108 may then be inserted into an opening 118 in the head 104 to complete assembly of the putter 100. As shown in FIG. 9, the head 104 has a striking face 120 formed by a flat, planar surface. Generally, before swinging the putter, the golfer will place the head 104 near the ball, and will line up the striking face 120 so that it is perpendicular to the desired direction of roll of the ball. At that point the golfer also insures that the ball is centered in the middle of the striking face 120. When swinging the putter, the golfer will attempt to hit the ball with the head 104 in the same orientation as above, as the head moves in the same direction that the ball is desired to follow. Each of the components of the putter 100 will be described in greater detail below.

Figure 5:
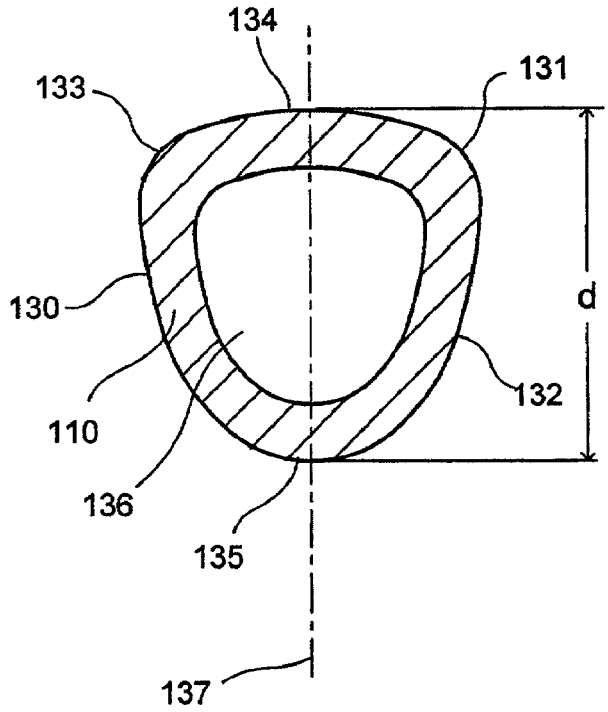
FIG. 5 is a cross sectional view on line V-V of FIG. 2.

The grip 110 is designed to provide an anatomically correct and comfortable grip for the player grasping the putter. In addition, the grip 110 also promotes gripping the putter 100 in the proper orientation, so that the head 104 naturally falls in the proper orientation to hit the ball correctly. In the exemplary embodiment, the grip 110 has a cross section shaped as a cardioid ("heart-shaped"), as shown in FIG. 5. The cardioid shape is shown in FIG. 5 as a three-sided shape having two edges 131 and 133 formed of a smaller radius than the third edge 135 and the sides 130, 132 and 134 have a generally curved or radius shape to smoothly transition between the radii of the edges 131, 133 and 135. Those skilled in the art will understand that the term three-sided does not necessarily indicate that any of the sides are flat or planar. In fact, the current United States Golf Association (USGA) rules allow a maximum of one side of the grip to be flat. As seen in the figures, the exemplary embodiment of the present invention does not have any flat sides. When the putter 100 is aligned correctly, the side 134 opposite the larger radius 135 is substantially perpendicular to the ball striking face 120 of the head 104. This cardioid shape of the grip 110 matches the shape that a player's hands naturally take when they are brought together in the front of the body to wrap around a pole-like structure. As a result, the player's hands fit comfortably around the grip 110, without causing undue stress and tension to the hands, wrists and forearms.

The cardioid shape of the grip 110 offers additional advantages because the cross-sectional shape of the grip 110, as shown in FIG. 5, is symmetrical about the plane 137 that is perpendicular to the cross-sectional shape. The plane 137 dissects the edge 135 and the side 134 along the entire length of the grip 110 because the grip 110 in the exemplary embodiment is non-tapered. Thus, the grip 110 has the same diameter from the cap 112 to the beginning of the transition section 114. In addition, the plane 137 is parallel to the plane of the putter face 120. As will be described in greater detail below, the putter face 120 may have a slight loft angle, but there is a plane in which the center point A of the face 120 (shown in FIG. 2) lies that is perpendicular to the plane of the top surface 194 of the head 104. The plane 137 is parallel to this plane in which the center point A of the face 120 lies.

Since the grip 110 is symmetrical about the plane 137, it can be grasped comfortably in the orientation dictated by the player's physiology. This gives the player immediate feedback on whether the putter 100 is being grasped in the proper orientation, because an incorrect orientation will cause the grip 110 to feel uncomfortable and the head 104 and face 120 to be oriented incorrectly. The player will naturally rotate the putter 100 until the grip 110 feels comfortable. Since the plane 137 is parallel to the plane of the face 120, this comfortable grasping of the grip 110 also provides for the proper orientation of the putter 100, i.e., the face 120 is parallel to the movement of the head 104 during the putting stroke. In addition, players may utilize the above described features by grasping at any point along the entire length of the grip 110 because the exemplary embodiment of the grip 110 is non-tapered. For example, a taller player may grasp the grip 110 more towards the cap 112, whereas a shorter player may grasp the grip 110 closer to the transition section 114. In either case, the player's hands will fit comfortably around the grip 110 and the face 120 alignment will be correct.

The cardioid shape of the grip 110 also provides a self-centering function. The edges 131, 133 and 135 and sides 130, 132 and 134 shown in the cross sectional view of FIG. 5 match the curves formed by the palm and fingers of the golfer's hands as they grasp the grip 110. If the putter 100 is slightly rotated away from the ideal orientation, the force applied by the player's hands when grasping the edges and sides 130-135 tends to bring the putter 100 back to the proper orientation. The shape of the grip 110 places the longitudinal axis of the grip 110 and the shaft 102 in alignment with the long palmer axis of the player's hands. This relieves stress on the player's hands and provides for a more comfortable grip.

The cardioid shape of grip 110 also allows for the isolation of the player's wrists while swinging putter 100, i.e., the player's wrists do not appreciably break while swinging the putter 100. The ideal body alignment for a player when putting is the formation of an isosceles triangle where the hands gripping the putter form the first corner of the triangle, each arm is a side and leads up to the shoulder area which form the remaining two corners. The final side is an imaginary horizontal line across the chest area connecting the two shoulders. The player should maintain this triangle through the backswing, bringing the putter forward to strike the ball and through the ball at the finish of the stroke. The isolation of the wrists when holding the grip 110 allows the player to maintain this putting triangle through the entire putting stroke.

The grip 110 may be formed in several sizes, to accommodate the hands of different players. For example, the distance 'd' shown in FIG. 5 may be of about 1 to 1-¾ inches. The current maximum size of the grip on a putter is dictated by the rules of the USGA. For a putter, this allowable size corresponds to a maximum dimension 'd' of 1 ¾ inches in its longest diameter. In the exemplary embodiment, the longest dimension 'd' corresponds to the symmetrical axis 137. However, different shapes of the grip 110 may allow for a longest dimension 'd' that is not the symmetrical axis. In the exemplary embodiment shown, the grip 110 is formed separate from the shaft 102 and hosel 108 because any allowable grip size ('d') may be joined with the same shaft 102 and hosel 108. Thus, in the manufacturing process, only a single type of shaft 102 and hosel 108 needs to be fabricated to accommodate, for example, any of the grip sizes described above. The desired grip size may then be joined to the shaft 102 and hosel 108, for example, by molding the grip 110 over the shaft 102.

Since the grip 110 may be made from a polymer, the weight of the grip 110 may be the same for all grip sizes. Thus, there is no need to re-balance the putter for each grip size. The polymer of a smaller grip 110 may be impregnated with a metal (e.g., aluminum, tungsten, etc) or other material to make it as heavy as a larger grip 110. Those of skill in the art will understand that a grip of any size may be impregnated with a metal or other material. In addition, since the grip 110 is formed as a single monolithic piece and molded over the shaft 102, the kinesthetic feel of the club is transferred directly to the player's hands. There is no additional grip material (e.g., a grip made of rubber fitted over the shaft, etc) to insulate the player's hands from the rest of the putter 100.

The above described features for the grip 110 are applicable for any style of gripping the putter 100, e.g., traditional, reverse overlapping, claw grip, etc. In addition, the features of the grip 110 may be enjoyed by any player regardless of the proportion of finger to palm length, e.g., long fingers/short palm, short fingers/long palm, etc. The longitudinal length of the grip may be any size to accommodate the preferences of different players.

As shown in FIG. 5, the grip 110 may also include a cavity 136 formed by an inside wall in grip 110 that is generally the same cardioid shape as the outside of the grip 110. The cavity 136 may also be any other shape, for example, circular, oval, etc. As will be described in greater detail below, this cavity 136 may contain a weighting system for the putter 100. A removable cap 112 may also be included to close the cavity 136. The grip 110 may also be textured to provide a better feel for the player.

A transition section 114 may be formed between the lower part of the grip 110 and the upper part of the shaft 102 where the two components are joined. The grip 110 and the shaft 102 may have different cross sectional shapes and transition section 114 smoothly blends the shapes of the two sections so that stress concentrators caused by abrupt shape changes are avoided, and a pleasing appearance is obtained. In the present exemplary embodiment, the grip 110 may be molded over the shaft 102 in transition section 114.

The function of the shaft 102 is primarily structural, to give the putter 100 the proper length and rigidity. In the exemplary embodiment, the shaft length is approximately 18 inches. However, the shaft 102 may be formed in different lengths to accommodate the preferences of different players. The shaft 102 may have a cross sectional area smaller than that of the grip 110, to be less distracting when a shot is taken, and to have a more pleasing visual appearance. As described above, the shaft 102 may be made of a polymer by a polymer molding processes. As such, the shaft 102 may be a single piece of material without any seams allowing for more structural integrity than putters having seams in the shaft area. The shaft 102 may be a solid polymer piece or it may have a cavity of varying shape similar to the cavity 136 described for the grip 110.

The shaft 102 is in large part responsible for setting the stiffness of the entire putter 100, and thus should be very stiff to prevent unwanted deflection and torque during the swing. In particular, USGA regulations mandate that the shaft portion must deflect the same amount in each orthogonal direction under a test weight. This requirement may be met, for example, by making the shaft 102 sufficiently stiff that it will not deflect at all, or very little, in any orthogonal direction when placed under the test weight. A solid shaft may add more rigidity than a shaft with a cavity and an enhanced sensation feedback to the player because it eliminates unwanted harmonics in the shaft.

Figure 6:
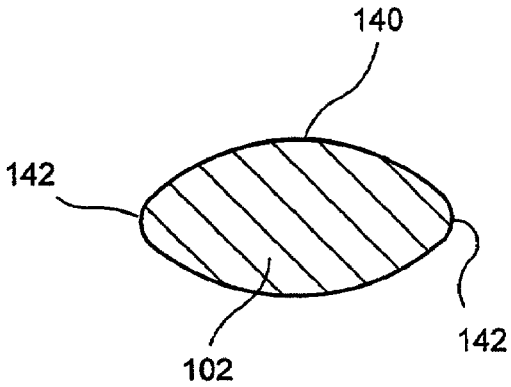
FIG. 6 is a cross sectional view on line VI-VI of FIG. 2.

A head orientation feature may also be built into the shaft 102 of the exemplary embodiment according to the present invention. The head orientation feature is designed to visually cue the golfer on the orientation of the head 104 relative to the golfer's hands. For example, the head orientation feature may include a shaped upper surface 140 of the shaft 102. The shaped surface 140 may be convex, and may form the upper surface of the shaft 102. In this example, the shaft 102 may have a cross section shaped as an oval or ellipse that is symmetric about two axes, with the shaped surface 140 forming the upper part of the oval or ellipse. FIG. 6 shows a cross-sectional view of shaft 102 with shaped surface 140 and edges 142. During manufacturing of the putter 100, the shaft 102 may be assembled so that the major axis of the oval or ellipse is aligned in a desired orientation with head 104. For example, that axis may be parallel to the preferred direction of travel of the head during a swing. In this manner, the head orientation feature assists the golfer in aligning the head correctly before and during the swing.

When the golfer looks at the putter's head and at the golf ball, along the shaft 102, the shaped surface 140 gives an immediate feedback as to whether the head is aligned properly, i.e. with the striking face 120 perpendicular to the desired direction of motion to be imparted to the ball by the putter 100. This direction is typically also parallel to the intended direction of motion of the head in the swing. If shaped surface 140 is convex, it tends to magnify very small amounts of rotation of the shaft 102, since the eye can notice the position of the peak of shaped surface 140 relative to edges 142. The golfer is then able to correct any deviations from the desired orientation of the putter head 104. Shaped surface 140 thus can instantly cue the golfer to the proper orientation of the shaft 102, and thus of the head 104 connected thereto, without the golfer having to concentrate on the head orientation feature. This head orientation feature according to this exemplary embodiment of the invention does not distract the golfer from concentrating on other factors necessary to complete the putt.

Figure 2:
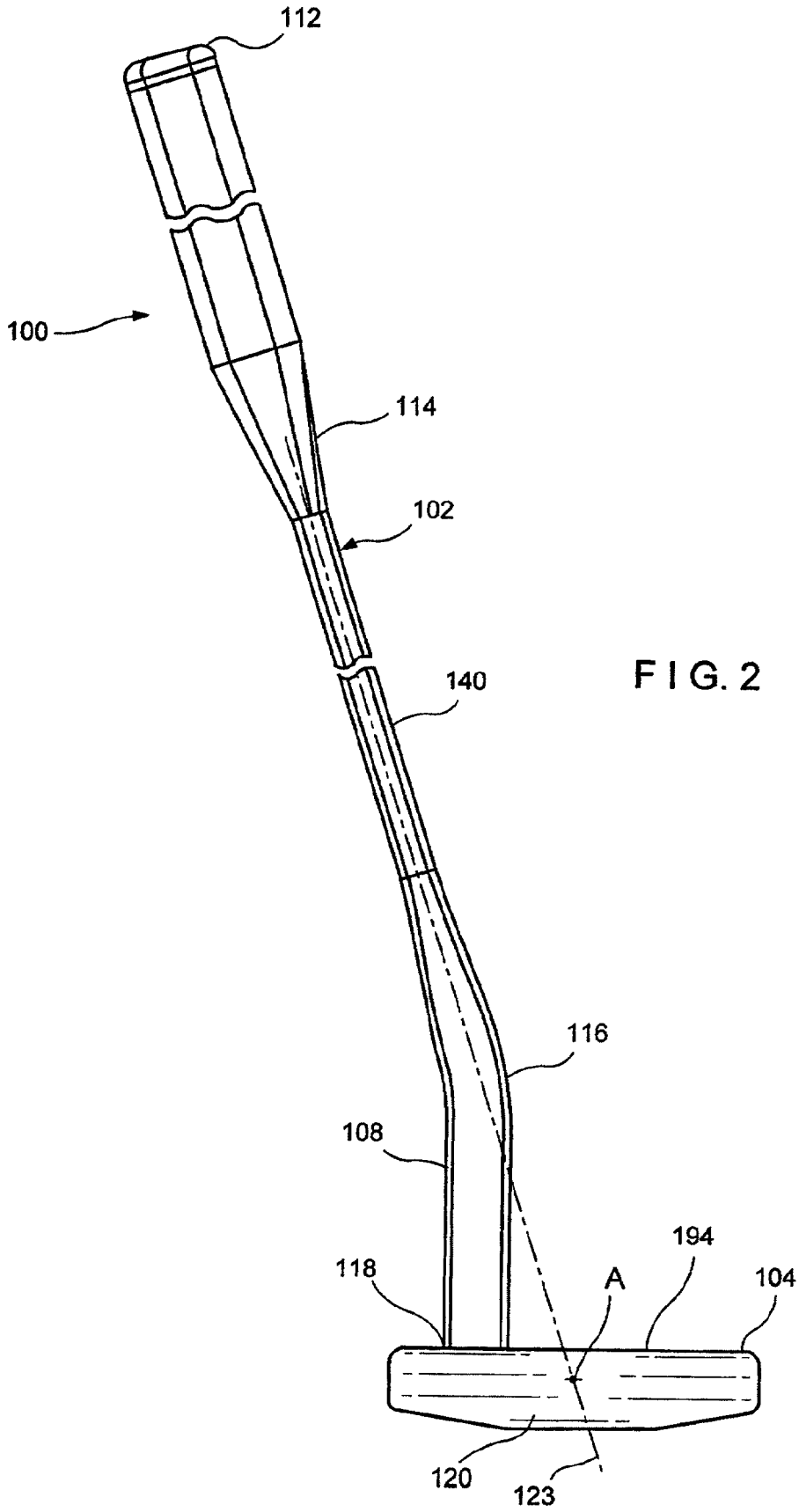
FIG. 2 is a side view showing the integrated putter of FIG. 1.
Figure 3:
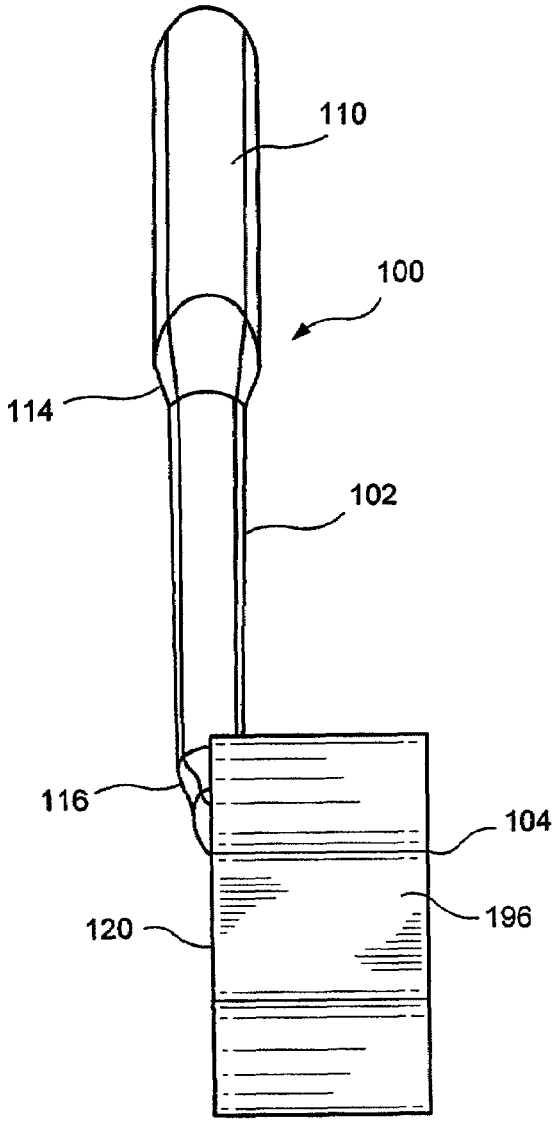
FIG. 3 is a front view showing the integrated putter of FIG. 1.
Figure 4:
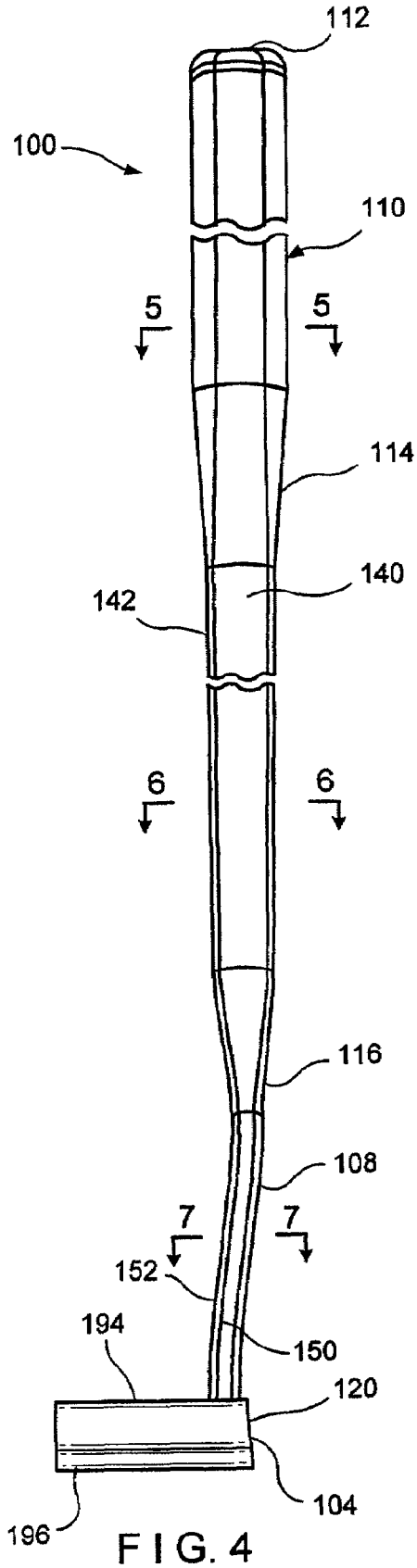
FIG. 4 is a top view showing the integrated putter of FIG. 1.

In addition, the visual feedback from the shaft 102 also allows for proper orientation of the player's body. As shown in FIG. 2, when the bottom of the head 104 is parallel to the ground, as it would be when a player is addressing the ball before putting, the centerline 123 of the shaft 102 (i.e., the longitudinal axis of the shaft 102) is in a plane at an angle relative to the ground. This angle is the angle at the intersection of the centerline 123 of the shaft 102 and the center of the head 104. The angle may be different for different embodiments of the putter according to the present invention based on the orientation of the shaft 102 and the hosel 108. If the shaped surface were flat, this flat surface would lie in a plane parallel to the plane described for the centerline 123. However, since the exemplary embodiment shows the shaped surface 140 as a convex surface, there are a series of parallel planes that longitudinally intersect the shaped surface 140 and are parallel to the plane described for the centerline 123. The proper orientation for putting will have the player's body in the same plane or a plane parallel to these planes. For example, when the player addresses the ball, the knees should be bent with the legs forming a plane between the knees and the hips. This plane of the legs should be parallel to the plane described for the centerline 123. If the player receives visual feedback from the shaped surface 140 that the alignment is not correct, this knee bend may be one of the factors that the player corrects in order to bring the body and the putter into alignment.

In a further example, when the player grasps the grip 110, the arms form a plane from the hands through the shoulder area. The design of the grip 110 assures that the arms form this plane, while the design of the shaft 102 assures that the player orients this plane correctly when putting. Proper alignment by the player will result in the plane formed by the arms lying in the same or a parallel plane to the plane described for the centerline 123. Once again, if the player receives visual feedback from the shaped surface 140 that the alignment is not correct, the player may factor in correction of the alignment of the arms and upper body in order to bring the body and the putter into alignment.

When a player achieves proper alignment using the visual cues from the shaft 102 and then strikes the ball, the movement of the putter face 120 will be in a line of each of the parallel planes. For example, as shown in FIG. 2, the plane described for centerline 123 passes through point A on the head 104. If the player's alignment is correct as indicated by the visual cues of the shaft 102, the movement of point A during the putting stroke will be in a line that remains in the plane described for centerline 123. Thus, the shaft 102 provides for proper body alignment and proper alignment of the head 104.

Although the present exemplary embodiment describes a convex shaped surface 140, other shapes may be suitable. For example, a rounded triangular surface, or a faceted surface may also provide the desired visual contrast necessary to recognize very small variations in the shaft's angle of rotation. Other examples of shapes that may be suitable for the shaft 102 include shapes having cross-sections that are circular, nearly circular (e.g., a multi-faceted polygon approximating a circle), an ovoid of any shape (e.g., varying major and minor axes), rectangular, square, star-shaped, etc. In another exemplary embodiment, the shaped surface 140 may be finished with a coating or texture that maximizes the visual contrast provided. For example, different colors or shaft treatments (e.g., a knurled finish) may be used to further increase the visual contrast that the player sees when the putter 100 is not aligned properly.

The shaft 102 may be tapered or non-tapered. A non-tapered shaft will have the same cross section along the entire length of the shaft 102. A tapered shaft may be tapered in either direction, i.e., a larger cross section near the grip 110 than near the hosel 108 or a larger cross section near the hosel 108 than near the grip 110. The tapering of the shaft 102 may be a stepped tapering having very small steps giving a smooth appearance to the shaft 102, while maintaining the rigidity of the shaft 102. A second transition region 116 connects the shaft 102 to the hosel 108. Transition region 116 has the purpose of smoothly transitioning from the shape of the shaft 102 to the shape of the hosel 108, which in the exemplary embodiment shown are different. As in the case of first transition region 114, second transition region 116 avoids abrupt changes in shape of the components, so that stress concentrators are avoided, and the putter has more aesthetic appeal.

In another exemplary embodiment, the shaft 102 may be formed of a polymer material (or other composite material) which may be molded around a solid core. The solid core may be any material, for example, metal, polymer, etc. The shaft 102 and the solid core may be of any shape. For example, the shaft 102 may be in the shape as described above and illustrated in the figures. Whereas, the solid core may have the same cross-section or a circular cross-section. Such a solid core shaft (or any solid shaft) may increase the velocity of transmission of the sound and feel of the ball strike. Thus, a player may receive feedback more quickly than with a hollow shaft. Those of skill in the art will understand that the grip 110 may be formed in the same manner, i.e., a polymer (or other composite material) molded around a solid core.

In another exemplary embodiment, the shaft 102 may include protruding ribs to stiffen the shaft 102. The ribs may be a series of parallel circular ribs, linear longitudinal ribs or any other shape protruding ribs that stiffen the shaft 102 or provide a visual contrast for the player. The addition of ribs may create a non-uniform surface area for the shaft 102. This may add to the visual contrast for the alignment feature of the shaft 102. Those of skill in the art will understand that other types of protrusions may also provide the same features, e.g., honeycomb, rectangular, etc.

The hosel 108 shown in the exemplary embodiments of the present invention has several purposes, other than connecting the head 104 with the shaft 102. For example, an alignment feature 118 may be included at the interface of the hosel 108 and the head 104. The alignment feature ensures that the head 104 will be in the correct orientation relative to the shaft 102 after the components of the putter 100 are assembled. As described above, the shaft 102 and the grip 110 include various aids to help the golfer align the head 104. As described above these aids include the anatomically shaped grip 110 and the shaped surface 140. Thus, the alignment feature 118 assures that the putter 100 is assembled correctly in order for the other aids to be effective. The alignment feature 118 also facilitates the assembly operation to mate the two components, so that the complete putter 100 can be assembled inexpensively and with little chance of mistakes being made. This feature also allows easy replacement of the grip-shaft-hosel section if either that section or the head 104 become damaged.

Figure 7:
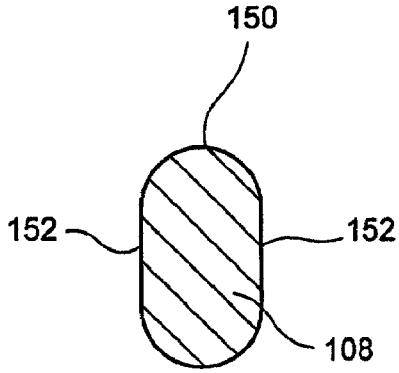
FIG. 7 is a cross sectional view on line VII-VII of FIG. 2.

In one exemplary embodiment, alignment feature 118 includes a unidirectional shape of the bottom portion of the hosel 108, cooperating with a correspondingly shaped recess formed in head 104. For example, as shown in FIG. 7, the bottom portion of hosel section 108 may have an oval cross section, fitting in an oval opening of the head 104. Other shapes may also be utilized instead of the oval section shown. Any shape which permits assembly in one orientation only would be suitable for this purpose. In addition, the alignment portion may include a feature which limits or controls the depth of penetration of the hosel 108 into the head 104. For example, there may be a taper on the hosel 108 where it can be inserted up to a certain depth of the head 104, but no more because the hosel 108 becomes too large for further penetration into the head 104. This feature also allows for ease of assembly of the putter 100. The length of the hosel may be varied within the limits prescribed by the USGA.

The hosel 108 also further assists the golfer in aligning head 104 in the proper orientation to strike the ball. In the exemplary embodiment shown in FIGS. 4 and 7, the hosel 108 includes an arc formed by a radius having an arc center point 150 that runs along the front of the cross section. When the golfer looks at the ball along the shaft 102, the arc center point 150 appears as a straight line between sides 152 pointing to the front part of the head 104, where the ball should be struck. If the putter 100 is correctly oriented, the straight line of the arc center point 150 will be centered between sides 152, and point to the ball. If the putter 100 is not correctly oriented, the arc center point 150 and sides 152 will not form a symmetric picture, indicating that the head 104 is not properly aligned to strike the ball.

In embodiments where the head orientation features of the shaft 102 include both the shaped surface 140 and the linear arc center point 150 of the hosel 108, an especially effective alignment method is provided. With this configuration, the golfer may be certain that head 104 is properly aligned when the perceived peak of shaped surface 140 lines up with the arc center point 150, forming what visually appears to be a continuous straight line pointing to the head. This alignment gives the golfer a cross-hair effect when aligned properly. This alignment method is very intuitive, and minimally distracts the golfer from the main task of swinging the putter.

The hosel 108 and second transition region 116 form an offset between the shaft 102 and head 104, best seen in FIG. 2. This offset allows the hosel 108 to be attached to the head 104 near an edge of the head 104, while the alignment features discussed above point directly to the center of striking face 120, shown as point A in FIG. 2. As shown in FIG. 2, the centerline 123 of the shaft 102 passes directly through point A. It is beneficial for the arc center point 150 and top of curved surface 140 to point to the ideal striking point, to facilitate alignment of the head with the ball. It may also be possible to increase or decrease this hosel offset (the angle), have a hosel 108 with no offset or have a hosel 108 with an onset (e.g., an angle opposite the offset angle).

In addition, the length and shape of the hosel 108 may vary. For example, other examples of shapes that may be suitable for the hosel 108 include shapes having cross-sections that are circular, nearly circular (e.g., a multi-faceted polygon approximating a circle), an ovoid of any shape (e.g., varying major and minor axes), rectangular, square, star-shaped, etc. The second transition region 116 may also morph in a different manner from the shaft 102 to the hosel 108 than illustrated in the figures. For example, the transition region 116 may be more abrupt (i.e., the shaft 102 morphs into the hosel 108 in a shorter length). In another example, the shaft 102 and the hosel 108 may have the same cross-sectional shape with no offset of the orientation in the transition region 116. Those of skill in the art will understand that there are a number of possible shapes for the transition region 116 which maintain the character of the present invention.

The hosel 108 preferably connects with the head 104 near the heel, rather than at the center of the head, because face balancing of the club is assured both with and without a weighting system (as described below). However, the insertion point of the hosel 108 may be anywhere from the heel through the toe of the head 104. The hosel 108 may have a vibration damper where the hosel 108 is inserted into the head 104 to prevent unwanted vibration from radiating to the shaft 102 and grip 110. The vibration damper may be, for example, a higher density polymer or matrix material than the surrounding material. The vibration damper may enhance the sensitivity of the club and give the player more accurate kinesthetic feedback and audio feedback when the ball is struck by the head 104.

As described above, the head 104 connects with the hosel 108. Alignment feature 118 insures that every time the head 104 is connected to hosel-shaft-grip portion of putter 100, the orientation of the head 104 is consistent with the orientation of the various features of the grip 110, the shaft 102 and hosel 108 that assist the player in aligning the head 104 with the ball. The assembly of the putter 100 is therefore simplified, since the components cannot be assembled incorrectly, and no additional steps for checking the alignment of the head 104 and hosel-shaft-grip are required.

As with the other components of the putter 100, the head 104 may be made of a polymer material using standard polymer molding techniques (e.g., injection molding). The striking face 120 of the head 104 may be smooth or textured. A textured striking face 120 may have any desired pattern. The exemplary embodiment of the head 104 is shown with the toe to heel width ('w') being greater than the depth (front to aft) in order to conform to the USGA rules.

The head 104 also includes features that aid the player in properly lining up the striking face 120 with the ball. As shown in the exemplary embodiment according to the present invention, with reference to FIGS. 8 and 9, a ball aiming feature is also built in the head 104 to facilitate the process of aligning the head with the ball, so that the ball is correctly struck by striking face 120. In the exemplary embodiment shown, striking face 120 is a flat, planar surface extending the width 'w' of the head 104. When the player strikes a golf ball, the orientation of striking face 120 relative to the direction of motion that is desired of the ball is very important to achieving the desired result. Unless terrain features intervene, basic physics requires that the ball will tend to gain a velocity perpendicular to the plane of the striking face 120 after being hit. If striking face 120 is not perpendicular to the desired direction of motion at the time the ball is struck, the ball will likely not travel in the desired direction or achieve the desired distance. In fact, the whole head 104 should be moving in the desired direction when the ball is struck, to avoid imparting a rotation to the ball in addition to a translation motion.

Figure 8:
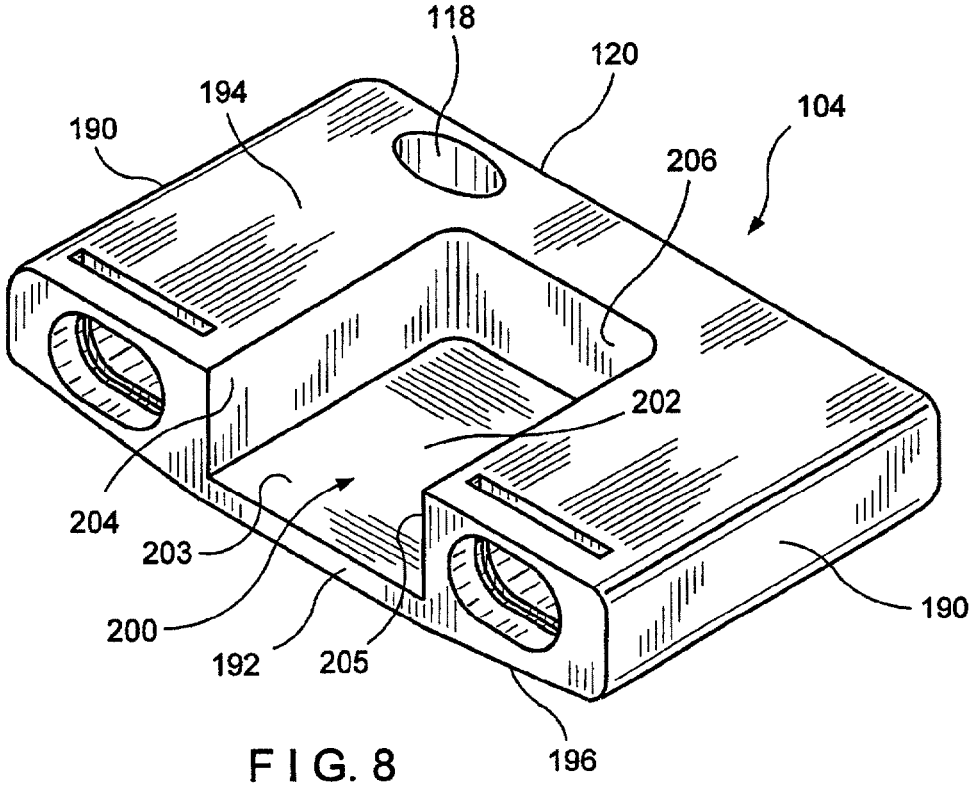
FIG. 8 is a perspective view of the head portion of the integrated putter according to the invention.

In view of the desirability of striking the ball with the striking face 120 perpendicular to the desired direction of motion, and with the head 104 also moving in the desired direction of motion, the head 104 is provided with features designed to assist the player with these tasks. For example, as shown in FIG. 8, the outline of the head 104 seen from above consists of straight lines forming right angles with each other. These lines are all parallel or perpendicular to the plane of the striking face 120, to simplify visually determining the orientation of the striking face 120. Specifically, side surfaces 190 are perpendicular to the striking face 120, and the rear surface 192 is parallel to it. The presence in the player's field of view of contours at other angles could cause ambiguities regarding the proper positioning of the head 104. Every edge seen from above head 104 is thus either perpendicular or parallel to the striking face 120, and thus to the preferred direction of movement of the head 104 during the swing path.

The striking face 120 may be perpendicular to the top and bottom surfaces 194, 196, or may be set to a slight angle to provide some loft to the ball once it is struck. For example, striking face 120 may be at an angle of about 1-5 degrees facing up, towards upper surface 194. This loft angle helps to slightly lift the ball when it is struck. For example, when the ball is resting, it may be at an elevation that is slightly lower than the plane of the upper surface of the grass on a green because the weight of the ball, the impact of the ball or a previously played ball, or players walking indented the area where the ball is resting. Thus, the ball needs to be slightly elevated at initial impact to bring it out of the indentation. However, the goal is to have the ball begin rolling as soon as it touches the surface, instead of skidding. This feature helps improve the distance and directional control of the ball. In this exemplary embodiment, lower surface 196 is formed of three facets: a bottom facet parallel to upper surface 194, and two angled facets. In this manner, a smaller surface area of bottom surface 196 reduces point drag along the ground during the swing. The reduction of point drag affords more control to the player, especially when using the putter 100 in locations off the green (e.g., the fringe apron of the green). This feature is best illustrated in the view shown by FIG. 3.

The head 104 of the exemplary embodiment may also include an eye collimating device called a volumetric parallax sighting system (VPSS) 200. The proper stance of the player is extremely important when aiming the ball, so that the ball will drop in the hole. Specifically, the eyes of the player should be directly above the ball or in the same plane as the desired travel of the ball when aiming, such that the player's eyes, the ball and the target path to the hole all lie in a plane that is nearly perpendicular to the ground. When this stance is maintained, the player can aim at the hole by looking straight down the target line, a line connecting the ball and the desired path to the hole. If the player's eyes are not directly above the ball, the player has to aim along a line that transects the desired putter path, making the task of aiming the ball much more difficult. The VPSS 200 is intended to be used before swinging the putter 100, when the player lines up the head 104 with the ball.

According to the exemplary embodiment of the present invention, shown in FIGS. 8 and 9, the VPSS 200 may include a rectangular depression 202 placed approximately at the center of the head 104. In the exemplary embodiment, the depression 202 has two side walls 204 and 205 and a front wall 206 with the back being open. Those of skill in the art will understand that the depression may also be completely enclosed, i.e., also have a back wall. The bottom surface 203 of the depression 202 may be parallel to the upper and lower surfaces 194, 196 of the head 104. The walls 204-206 may be perpendicular to the bottom surface 203. Depression 202 may be placed, for example, adjacent to the region of striking face 120 where the ball should be contacted, to further assist in aligning the head with the ball. When the VPSS 200 of the exemplary embodiment is seen from above, and the player's eyes are in the proper position, the VPSS 200 will appear as a two dimensional feature of the head 104. For example, the bottom surface 203 of depression 202 will appear to lie in the same plane as top surface 194 of the head 104 and the walls 204-206 will appear simply as lines in the continuous plane form by the bottom surface 203 and top surface 194. The view shown by FIG. 9 is an example of how the VPSS 200 will appear if the player's eyes are aligned correctly.

If the player's eyes are not correctly positioned above the head, and thus above the ball, when the putter is positioned before swinging, the VPSS 200 will appear as a three dimensional feature of the head 104. For example, one or more of the walls 204-206 will not simply appear as lines, but will appear to have depth. The bottom surface 203 will appear to lie on a different plane than top surface 194 of the head 104. Thus, the VPSS 200 will appear in three dimensions to the player which allows the player to instantly recognize the improper address position and correct it before swinging. The view shown by FIG. 8 is an example of how the VPSS 200 will appear if the player's eyes are aligned incorrectly.

The VPSS 200 provides a rapid, intuitive and non distracting manner of checking the player's address position before swinging. The walls 204-206 may be distinctly visible as separate from bottom surface 203. The color or texture of the depression 202 may thus be selected to maximize the contrast, and further simplify the visual cues given to the player.

As described above, each of the components (i.e., head 104, hosel 108, shaft 102 and grip 110) of the putter 100 may be made of a polymer material. The properties of the polymer, including any impregnation materials, may be selected to provide the putter 100 with the desired weight, sound and feel, as well as the required rigidity and torque. The polymer's properties may be varied within the part, such that, for example, the shaft 102 may be made of a more dense and thus more rigid material than the grip 110. The hardness of the head 104 may also be controlled by selecting the proper polymer, for example to compensate for and compliment the ball's hardness and composition. The putter's stiffness, weight, flex/torque and strength may be manipulated by varying the density and cross section of the various sections, to give the putter 100 the desired properties. For example, while it is desirable to make the putter 100 very stiff so that there is no appreciable flexing during the transition from backswing to the forward stroke, the putter 100 should not be so rigid that there is no flexing when the ball is struck. The flexing or deflection of the putter 100 when striking the ball allows the player to feel the striking and better control the roll of the ball. However, the deflection of the putter 100 should be perpendicular to the travel path of the ball with no torque of the putter 100.

The putter 100, when made of a polymer material, may be up to 100% heavier than a conventional putter allowing for a slower, more rhythmical swing to impart the same amount of momentum to the ball. Thus, the ball may travel a greater distance with a slower swing, but the slower swing allows the player to exert more control over the ball. In a conventional putter, it is possible to make a heavier head to give more momentum. However, it changes the balance of the putter and therefore compromises the control the player can exert over the clubhead. The exemplary embodiment of the present invention allows for a heavier putter without sacrificing the balance of the putter 100.

The balance of a golf club, including putters, generally is defined in terms of the logarithmic fulcrum of the club. The logarithmic fulcrum of a club is approximately 19 ½ inches from the top of the club, e.g., referring to FIG. 4, the logarithmic fulcrum is 19 ½ inches down from the top of the cap 112 which lies somewhere on the shaft 102. A perfectly balanced club would mean that the club would balance on the logarithmic fulcrum point. In the exemplary embodiment of the putter 100, the distance from the logarithmic fulcrum to the top of the club is greater than the distance from the logarithmic fulcrum to the bottom of the club. Thus, to achieve balancing, the lower portion of the club (i.e., the portion below the logarithmic fulcrum) must weigh more than the top portion of the club. By varying the polymer materials and impregnating materials, a putter according to the present invention may be manufactured as a perfectly balanced club, as one with the feeling of more weight in the lower portion of the club, or as one with the feeling of more weight in the top portion of the club. In practice, most players prefer a putter that is not perfectly balanced, but has the feeling of slightly more weight in the lower portion of the club so that they can get a better feel of the ball strike and swing. As described below, the putter may also include weighting systems for players to customize the weight and feel of their putter.

The exemplary embodiment of the putter according to the present invention may also include a weighting system used to customize the putter. Changing the weight distribution between the two portions of the club may move the center of rotation of the putter, which is the point about which the putter rotates during the swing. Weighting the head portion also affects the amount of energy that can be imparted to the ball being struck. Since the momentum of the head is equal to its velocity times its mass, the larger the head's mass the greater impulse may be imparted to the ball, for a given velocity. Alternatively, the same impulse may be imparted by striking the ball with less speed, if the head end (the lower portion of the club) is more massive. Less speed then translates to a slower, more controllable swing, better distance control, and smoother operation.

Figure 10:
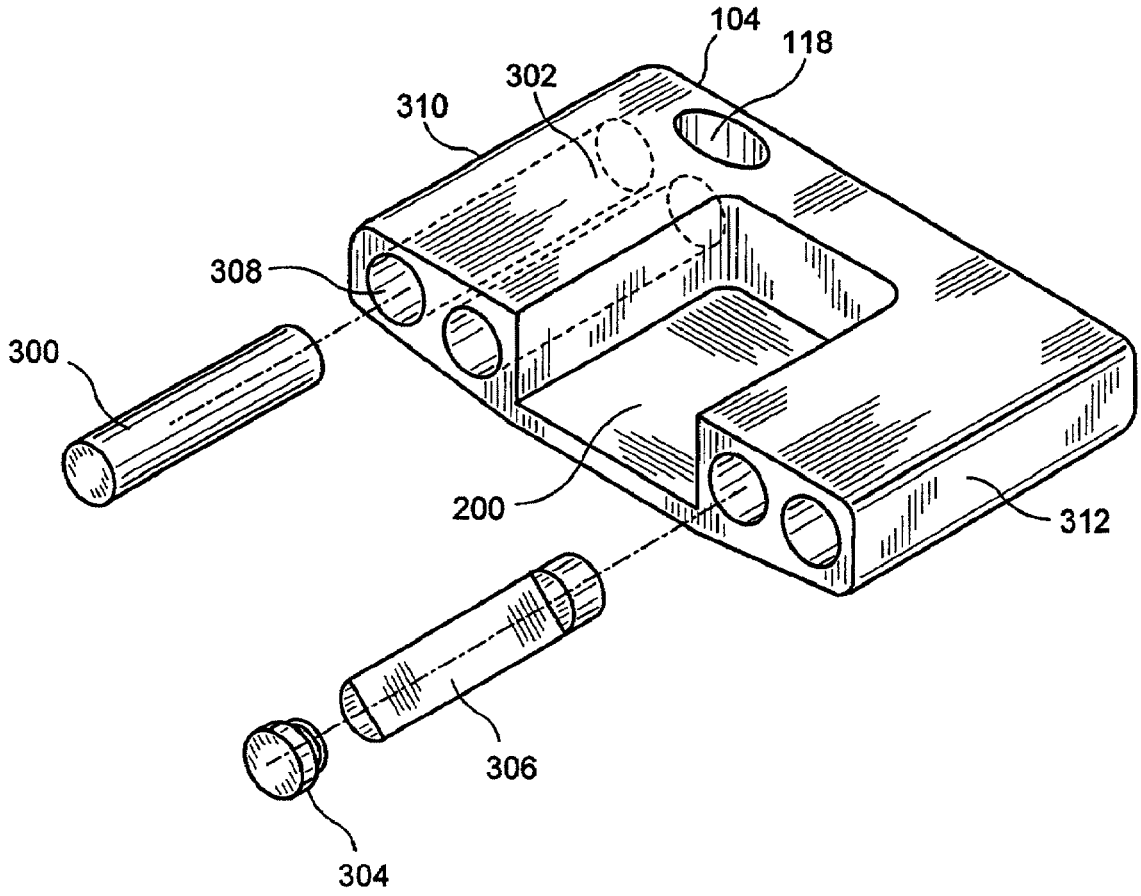
FIG. 10 is a perspective view showing the head weights system according to an embodiment of the present invention.

FIG. 10 show an exemplary embodiment of a weighting system used for the head 104. In this embodiment, a series of tunnels 302 are formed in the thick sections of the head 104 that surround the VPSS 200. The tunnels 302 extend longitudinally in the head 104, and may be spaced laterally from the heel to the toe of the head 104. Weights 300 can be inserted in the tunnels 302, where they are held in place with conventional means, for example by threading them in threads tapped in the tunnels 302. The position of the weights 300 in the tunnels 302 can be chosen to give the head 104 a more forward or more aft center of gravity, to affect how it will strike the ball. The weights 300 may be provided with different masses, to accommodate different preferences of the players. Several channels 302 may be provided along the width of head 104. Weights of different mass may be placed in the channels, to move the head's center of gravity towards the heel 310 or the toe 312. This ability is useful to customize the feel of the putter 100, or to correct incorrect swinging technique of a particular player (e.g., the weighting system may be used to correct a gate putter).

The head 104 of the putter 100 may be further customized by using weights 306 that are not symmetrical about their longitudinal axis. For example, the weights 306 may have a semicircular cross section. By rotating the weights 306 within the channel 302, the center of gravity of the head 104 may be moved up or down, depending on where the solid part of the weight 306 is rotated. This feature gives control over the vertical position of the head's center of gravity (CG). For example, this allows the raising of the CG when playing fast greens, and the lowering of the CG of the head 104 when playing slower greens. The changing of the CG may also change the effective loft angle of the putter sometimes referred to as the effective face angle. As described above, the face angle of the putter may be about 1-5 degrees. However, the higher the CG, the lower the effective face angle. Thus, a three degree face angle putter with a raised CG may have an effective face angle that is less than 3 degrees. The lowering of the effective face angle de-lofts the club and cause less loft (or elevation) on the ball when it is struck by the club.

Another example of a weight configuration that may raise and lower the CG of the putter may be a non-symmetric weight such as a trapezoidal weight. Such a weight may be rotated about a center axis. If the larger portion of the trapezoid is rotated to be on top, more weight would be on top and effectively raise the CG. Whereas, if the larger portion of the trapezoid was rotated to be on the bottom, the CG would be lowered. Such a weight could also be rotated such that the larger portion was toward the heel or toe of the club, based on the player's preference. Those skilled in the art will understand that there are other non-trapezoidal shapes that may be used to accomplish the same non-symmetrical weighting of the head 104. In a further example, the weight could be a symmetrical shape (e.g., circle, square, etc), but be constructed of a bi-metal material where half of the shape was a lighter material than the other half. The rotation of the heavier half about an axis may accomplish the same non-symmetrical weighting of the head 104 as described above. Those skilled in the art will understand that in addition to bi-metal weights, any number of metals may be used (e.g., tri-metal, quad-metal, etc) to accomplish the weighting of the head according to the player's preferences.

A cap 304 may be included to secure the openings 308 of the channels 302. The cap 304 may be threaded in place, and may be used whether the weights 300, 306 are placed in the channels 302 or not. The weighting system of the head 104 thus permits the player to customize the feel of putter 100 by adjusting the position of the head 104 center of gravity in three axis, and by adjusting the mass of the head 104.

In general, it is desirable to concentrate most of the head's mass near the heel and toe portions 310, 312 of the head 104 to reduce twisting of the putter 100 when the ball is struck. It is also desirable to move the weight towards the rear, away from the striking face 120, to add stability to the head 104. Head to toe weight distribution can be controlled according to exemplary embodiments of the present invention. This feature allows to change the striking face balancing of the putter, to achieve a neutral balance, a 45 degree toe down, or even a 45 degree toe up balance. In this manner, putter 100 can accommodate so called gate putters and straight back and through putters alike.

Figure 12:
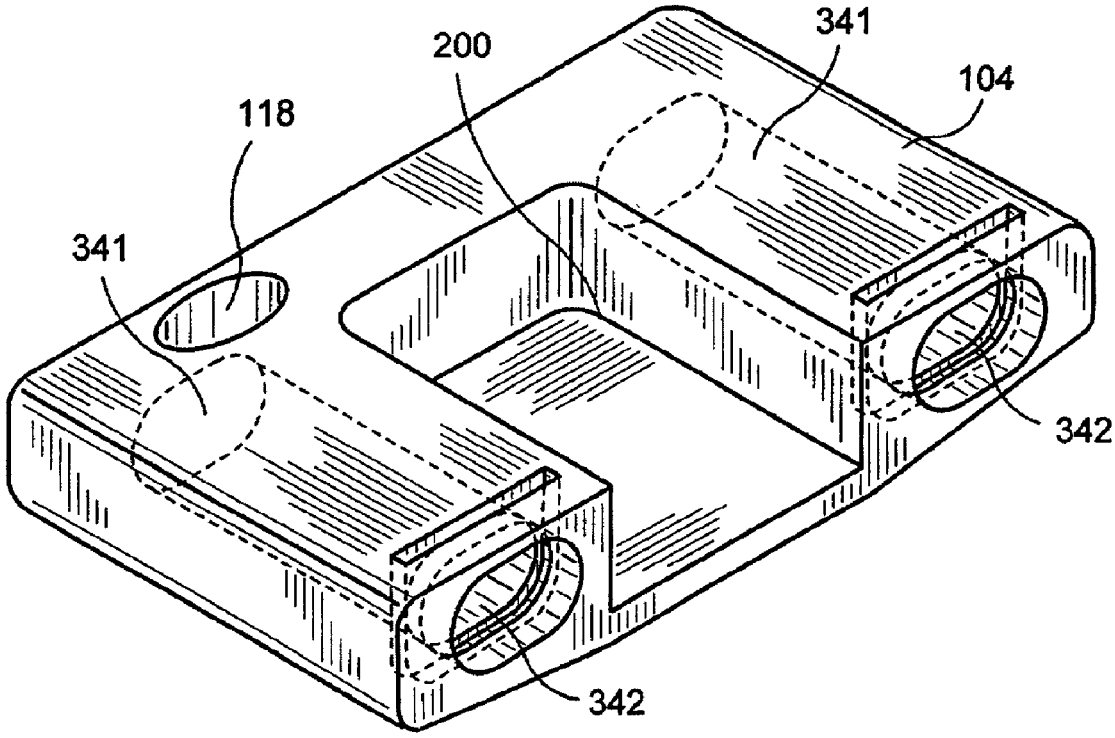
FIG. 12 is a perspective view showing an alternative embodiment of the head weight system according to the present invention.

FIG. 12 shows an alternative embodiment of the head weighting system according to the present invention. In this embodiment, the head 104 includes a single cavity 341 on each of opposite sides of the VPSS 200. Each cavity may be enclosed through the use of a door 342 that locks. The doors 342 may be designed such that they are neither obtrusive or visually distracting. The cavities 341 may accommodate weights in the same manner as the channels 302 described above, including weights of varying shapes and sizes. There may be a locking mechanism within the cavities 341 so that the weights may be locked at different positions within the cavities 341.

In a further exemplary embodiment, the weighting system for the head 104 may be a separate sole plate that may be attached to the head 104. There may be a series of soles plates that may be attached to vary the weight of the head 104. Those of skill in the art will understand that the weighting systems described with reference to FIGS. 10 and 12 are only exemplary and that there are numerous other arrangements that may be used to insert weights into the head 104 (e.g., multiple channels or cavities, weight insertion from the top or bottom surface of the head, external weighting, etc.).

In another exemplary embodiment, the head 104 may be a singular solid piece (e.g., in the same general shape as shown in FIG. 10, but without the cavities 308 for the insertion of weights. The weight of a solid head 104 may be varied using different polymer materials, impregnation methods or other composite materials. For example, the solid head 104 may include a solid metallic core surrounded by a polymer. In this type of arrangement, the head weighting may be varied through the use of external weights or the replacement of the head 104 with a different head 104 having a different weight.

Figure 11:
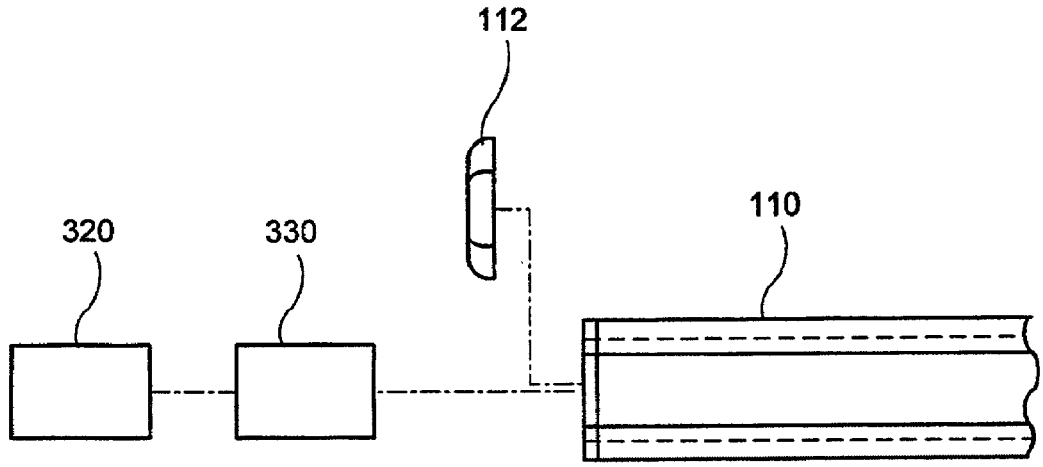
FIG. 11 is a perspective view showing the handle weight system according to an embodiment of the present invention.

FIG. 11 shows an exemplary embodiment of a weighting system for the grip 110. A hollow cavity 136 may be formed, for example, in the grip 110. The cavity 136 may extend along the grip 110 sufficiently to give a range of movement for the center of rotation of the putter 100. One or more weights 320, 330 may be inserted in the cavity 136, and may be secured at a desired distance along the grip 110. The further the weights 320, 330 are placed, the lower towards the head the center of rotation is found, if the mass of the head 104 is not changed. Weights 320 may be added and positioned to give the putter 100 the desired feel, and to balance the weight of the head 104. As described above, when the head becomes heavier, the putter 100 is moving away from logarithmic balance. A change in weight of the head 104, for example, through the addition of weights using the weighting system described above may be balanced by a corresponding change in weight in the grip 110, to retain the putter's logarithmic balance. This is sometime referred to as back weighting, where weight is added to both the head 104 and the grip 110, but the putter 100 remains in logarithmic balance (or the balance selected by the player). Thus, the putter 100 may become significantly heavier through the addition of weights in the head 104 and grip 110, but the feel of the putter remains the same because the balancing remains the same Weights 320, 330 may be secured within the cavity 136 with any conventional means. For example, weights 320, 330 may be threaded within the cavity 136, so that they may be locked in place at the desired position. A cap 112 may be utilized to close cavity 136, and further prevent movement of weights 320, 330. In one exemplary embodiment, the weighting system may include a central piece or pole that is attached to an inner portion of transition region 114 or secured in a ball and socket arrangement in the transition region 114. The central piece may then run up though the cavity 136 and the weights 320, 330 may be attached to the central piece. In this arrangement, an adjustment screw may be attached to the central piece through the cap 112 to move the weights 320, 330 within the cavity 136 without removing the cap 112. Similarly, the weights themselves may be shaped such that they may be inserted in the cavity and secured in a ball and socket arrangement.

Exemplary materials which may be used for the weights used in the head 104 and grip 110 may be, for example, tungsten, steel, brass, dense polymer, etc. Although the weights of the exemplary embodiment are adjustable, a different embodiment may employ fixed weights, which may be inserted during manufacture.

As described above, each of the components of the described golf club (e.g., grip 110, shaft 102, hosel 108 and head 104) may be formed of a polymer or composite material. The composite material may be, for example, a polymer impregnated with metal or other material, a variable density matrix composite, etc. The components may also be compression laminates or multiple laminates.

In the preceding specification, the present invention has been described with reference to specific exemplary embodiments thereof. It will, however, be evident to those skilled in the art that various modifications and changes may be made thereto without departing from the broadest spirit and scope of the present invention as set forth in the claims that follow. The specification and drawings are accordingly to be regarded in an illustrative rather than restrictive sense.

What is claimed is:

1. A putter comprising:

a grip having an anatomically correct shape to promote proper grasping of the putter, the shape including a first curve having a first radius and a second curve having a second radius, the first radius being larger than the second radius, wherein a portion of the first curve defines an area for placement of a user's thumbs;

a shaft having a first end and a second end, wherein the grip is attached to the first end of the shaft;

a hosel attached to the second end of the shaft;

a head attached to the hosel, the head having a striking face; and an alignment feature of the putter permitting assembly of the head onto the hosel only in an operable position wherein a centerline of the shaft and the striking face of the head have at least one point in common a plane that is tangential to the thumb portion of the grip is substantially perpendicular to the striking face of the head.

2. The putter according to claim 1, wherein each of the grip, the shaft, the hosel and the head are formed from one of a polymer material and a composite material.

3. The putter according to claim 1, further comprising a first balancing weight disposed in the grip and a second balancing weight disposed in the head.

4. The putter of claim 1, wherein the point of the striking face is a center point of percussion.

5. A putter system for assisting a golfer in completing a putt, the system comprising:

a grip for anatomically matching the golfer's hands, the grip including a first curve having a first radius and a second curve having a second radius, the first radius being larger than the second radius, wherein a portion of the first curve defines an area for placement of the golfer's thumbs;

a shaft extending from the grip, the shaft providing visual indication of a preferred orientation of the shaft to the golfer;

a head integrated with the shaft, the head providing visual indication to the golfer of a preferred orientation of the head; and an alignment feature adapted to precisely align the head with the shaft, wherein the alignment feature permits assembly of the head onto the hosel only in an operable position wherein a centerline of the shaft and a striking face of the head have at least one point in common a plane that is tangential to the thumb portion of the grip is substantially perpendicular to the striking face of the head.

6. The putter system according to claim 5, further comprising a parallax collimating device of the head for visually indicating to the golfer when a preferred stance is maintained.

7. The putter system according to claim 5, further comprising adjustable weighting systems to customize the putter system.

8. The putter system according to claim 5, further comprising a weighting system of the bead adapted to move a center of gravity of the head along three axes and to vary a mass of the head.

9. The putter system according to claim 5, further comprising a weighting system of the grip adapted to balance the putter system in conjunction with the weighing system of the head.

10. A putter comprising:

a grip having an anatomically correct shape to promote proper grasping of the putter, the shape including a first curve having a first radius and a second curve having a second radius, the first radius being larger than the second radius, wherein a portion of the first curve defines an area for placement of a user's thumbs;

a shalt having a first end and a second end, wherein the grip is attached to the first end of the shaft;

a hosel attached to the second end of the shaft;

a head attached to the hosel, the head having a striking face; and an alignment feature preventing the head from rotating relative to the hosel and the shaft, the alignment feature including a shaped portion of the hosel insertable into a complementing shaped opening of the head wherein an alignment feature of the putter permitting assembly of the head onto the hosel only in an operable position wherein a centerline of the shaft and the striking face of the head have at least one point in common, and wherein a plane that is tangential to the thumb portion of the grip is substantially perpendicular to the striking face of the head.

11. The putter of claim 10, wherein the shaped portion and complementing shaped opening is an oval.

12. The putter of claim 10, wherein the shaped portion and complementing shaped opening is one of a rectangle, a square and a star.

* * * * *